US008453750B2

(12) United States Patent
Solhaug et al.

(10) Patent No.: US 8,453,750 B2
(45) Date of Patent: Jun. 4, 2013

(54) WELL TOOLS UTILIZING SWELLABLE MATERIALS ACTIVATED ON DEMAND

(75) Inventors: Kristian Solhaug, Stavanger (NO); Alf K. Sevre, Houston, TX (US); Mark D. Kalman, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/197,973

(22) Filed: Aug. 4, 2011

(65) Prior Publication Data

US 2011/0315405 A1 Dec. 29, 2011

Related U.S. Application Data

(62) Division of application No. 12/410,042, filed on Mar. 24, 2009, now Pat. No. 8,047,298.

(51) Int. Cl.
*E21B 33/12* (2006.01)

(52) U.S. Cl.
USPC ..... 166/387; 166/179

(58) Field of Classification Search
USPC ..... 166/386, 387, 179
See application file for complete search history.

(56) References Cited

U.S. PATENT DOCUMENTS

| | | | |
|---|---|---|---|
| 2,144,026 | A | 1/1939 | Park |
| 2,814,947 | A | 12/1957 | Stegemeier at al. |
| 2,849,070 | A | 8/1958 | Maly |
| 2,945,541 | A | 7/1960 | Maly |
| 3,099,318 | A | 7/1963 | Miller et al. |
| 3,385,367 | A | 5/1968 | Kollsman |
| 3,918,523 | A | 11/1975 | Stuber |
| 4,137,970 | A | 2/1979 | Laflin et al. |
| 4,182,677 | A | 1/1980 | Bocard et al. |
| 4,234,197 | A | 11/1980 | Amancharla |
| 4,240,800 | A | 12/1980 | Fischer |

(Continued)

FOREIGN PATENT DOCUMENTS

| | | | |
|---|---|---|---|
| GB | 2396869 | A | 7/2004 |
| GB | 2406593 | A | 4/2005 |

(Continued)

OTHER PUBLICATIONS

EPO Communication dated Feb. 8, 2007, containing a Letter from the Opponent dated Jan. 31, 2007, for European Patent Application No. EP 01958642.9, 2 pages.

(Continued)

*Primary Examiner* — William P Neuder
(74) *Attorney, Agent, or Firm* — Smith IP Services, P.C.

(57) ABSTRACT

A well tool includes a generally tubular mandrel with a flow passage extending longitudinally through the mandrel, and a flow controller which initially prevents a fluid from contacting a swellable material, but which permits the fluid to contact the material in response to manipulation of pressure in the flow passage. Another well tool includes a swellable material, a generally tubular mandrel, and a conduit wrapped circumferentially about the mandrel, the conduit containing a fluid which, upon contact with the swellable material, causes the material to swell. A method of actuating a well tool in a well includes manipulating pressure in a flow passage extending through a tubular string, thereby opening at least one flow control device of the well tool which selectively permits fluid communication between a reservoir of the well tool and a swellable material of the well tool, whereby a fluid in the reservoir contacts the swellable material.

19 Claims, 8 Drawing Sheets

U.S. PATENT DOCUMENTS

| | | | | |
|---|---|---|---|---|
| 4,375,240 | A | 3/1983 | Baugh et al. | |
| 4,558,875 | A | 12/1985 | Yamaji et al. | |
| 4,633,950 | A | 1/1987 | Delhommer et al. | |
| 4,635,726 | A | 1/1987 | Walker | |
| 4,862,967 | A | 9/1989 | Harris | |
| 4,936,386 | A | 6/1990 | Colangelo | |
| 5,180,704 | A | 1/1993 | Reindl et al. | |
| 5,433,269 | A | 7/1995 | Hendrickson | |
| 5,523,357 | A | 6/1996 | Peterson | |
| 5,533,570 | A | 7/1996 | Streich et al. | |
| 5,718,287 | A | 2/1998 | Streich et al. | |
| 6,009,951 | A | 1/2000 | Coronado et al. | |
| 6,318,729 | B1 | 11/2001 | Pitts, Jr. et al. | |
| 6,575,251 | B2 | 6/2003 | Watson et al. | |
| 6,705,615 | B2 | 3/2004 | Milberger et al. | |
| 6,834,725 | B2 | 12/2004 | Whanger et al. | |
| 6,848,505 | B2 | 2/2005 | Richard et al. | |
| 6,938,689 | B2 | 9/2005 | Coronado | |
| 7,059,415 | B2 | 6/2006 | Bosma et al. | |
| 7,143,832 | B2 | 12/2006 | Freyer | |
| 7,219,541 | B2 | 5/2007 | DiFoggio | |
| 7,234,533 | B2 | 6/2007 | Gambier | |
| 7,240,546 | B2 | 7/2007 | DiFoggio | |
| 7,516,654 | B2 | 4/2009 | DiFoggio | |
| 7,665,537 | B2 * | 2/2010 | Patel et al. | 166/387 |
| 7,690,437 | B2 | 4/2010 | Guillot et al. | |
| 7,779,907 | B2 * | 8/2010 | Wagner et al. | 166/169 |
| 7,866,383 | B2 * | 1/2011 | Dusterhoft et al. | 166/227 |
| 7,866,408 | B2 | 1/2011 | Allison et al. | |
| 8,047,298 | B2 | 11/2011 | Solhaug et al. | |
| 8,047,928 | B2 * | 11/2011 | Bittner | 473/265 |
| 2004/0020662 | A1 | 2/2004 | Freyer | |
| 2004/0194971 | A1 | 10/2004 | Thomson | |
| 2004/0231861 | A1 | 11/2004 | Whanger et al. | |
| 2004/0261990 | A1 | 12/2004 | Bosma et al. | |
| 2005/0023003 | A1 | 2/2005 | Echols et al. | |
| 2005/0092485 | A1 | 5/2005 | Brezinski et al. | |
| 2005/0150661 | A1 | 7/2005 | Kenison et al. | |
| 2005/0171248 | A1 | 8/2005 | Li et al. | |
| 2005/0199401 | A1 | 9/2005 | Patel et al. | |
| 2006/0272806 | A1 | 12/2006 | Wilkie et al. | |
| 2007/0112242 | A1 | 5/2007 | Edmiston | |
| 2007/0151724 | A1 | 7/2007 | Ohmer et al. | |
| 2007/0246213 | A1 | 10/2007 | Hailey, Jr. | |
| 2007/0246225 | A1 * | 10/2007 | Hailey et al. | 166/386 |
| 2007/0257405 | A1 | 11/2007 | Freyer | |
| 2008/0023205 | A1 | 1/2008 | Craster et al. | |
| 2008/0110626 | A1 | 5/2008 | Allison et al. | |
| 2009/0084550 | A1 | 4/2009 | Korte et al. | |
| 2009/0179383 | A1 | 7/2009 | Koloy et al. | |
| 2009/0205816 | A1 | 8/2009 | De et al. | |
| 2009/0218107 | A1 | 9/2009 | Chauffe | |
| 2009/0229816 | A1 | 9/2009 | Lemme et al. | |
| 2010/0051294 | A1 | 3/2010 | Nutley et al. | |
| 2010/0139930 | A1 * | 6/2010 | Patel et al. | 166/387 |
| 2010/0155064 | A1 | 6/2010 | Nutley et al. | |
| 2010/0212883 | A1 | 8/2010 | Emerson et al. | |
| 2011/0083861 | A1 | 4/2011 | Allison et al. | |
| 2012/0048551 | A1 | 3/2012 | Allison et al. | |

FOREIGN PATENT DOCUMENTS

| | | | |
|---|---|---|---|
| GB | 2416796 | A | 2/2006 |
| GB | 2417270 | A | 2/2006 |
| GB | 2417271 | A | 2/2006 |
| GB | 2417272 | A | 2/2006 |
| GB | 2428263 | A | 1/2007 |
| GB | 2428264 | A | 1/2007 |
| JP | 04-363499 | | 12/1992 |
| JP | 09-151686 | | 6/1997 |
| JP | 2000-064764 | | 2/2000 |
| RU | 2157440 | C2 | 10/2000 |
| WO | 02059452 | A1 | 8/2002 |
| WO | 03006756 | A1 | 1/2003 |
| WO | 2005116394 | A1 | 12/2005 |
| WO | 2008060297 | A2 | 5/2008 |

OTHER PUBLICATIONS

EPO Communication of a Notice of Opposition dated Dec. 14, 2006 for European Patent Application No. EP 01958642.9, 16 pages.

International Search Report issued Nov. 13, 2001, for International Patent Application No, PCT/NO01/00275, 3 pages.

Chloroprene, Kirk-Othmer Encyclopedia of Chemical Technology, 1993, title and copyright pages and p. 70, vol. 6, John Wiley & Sons publisher, New York.

The Concise Oxford Dictionary undated, title page and pp. 148-149, 360-361, 740-741, 7th Edition, Clarendon Press, Oxford.

European Search Report issued May 18, 2006, for European Patent Application No. EP 06075453.8, 5 pages.

International Search Report and Written Opinion issued Jun. 17 2008, for International Patent Application Serial No. PCT/US06/60926, 6 pages.

International Search Report and written Opinion issued Feb. 21, 2007, for International Patent Application Serial No. PCT/US06/35052, 8 pages.

International Search Report and Written Opinion issued Mar. 21, 2008, for International Patent Application Serial No. PCT/US07/61703, 7 pages.

EasyWellSwellPacker Cable presentation, 2006, 2 pages.

U.S. Appl. No. 12/410,042, filed Mar. 24, 2009, 38 pages.

Office Action issued Mar. 15, 2011 for U.S. Appl. No. 12/410,042, 26 pages.

International Preliminary Report on Patentability with Written Opinion issued Aug. 20, 2009, for International Patent Application Serial No. PCT/US07/61703, 7 pages.

Office Action issued Dec. 10, 2009, for U.S. Appl. No. 11/939,968, 27 pages.

Final Office Action issued Jun. 7, 2010, for U.S. Appl. No. 11/939,968, 17 pages.

Advisory Action issued Aug. 13, 2010, for U.S. Appl. No. 11/939,968, 3 pages.

International Search Report and Written Opinion issued Oct. 14, 2010, for International Application Serial No. PCT/US10/027561, 9 pages.

Office Action issued Jun. 8, 2011, for U.S. Appl. No. 12/972,438, 19 pages.

International Search Report issued for International Patent Application No. PCT/US2006/060926, dated Jun. 17, 2008, 3 pages.

Written Opinion issued for International Patent Application No. PCT/US2006/060926, dated Jun. 17, 2008, 6 pages.

International Preliminary Report on Patentability issued Mar. 26, 2009, for International Patent Application Serial No. PCT/US07/35052, 5 pages.

International Preliminary Report on Patentability issued May 28, 2009, for International Patent Application Serial No. PCT/US06/60926, 8 pages.

Office Action issued Jun. 22, 2009, for U.S. Appl. No. 11/852,295, 16 pages.

International Preliminary Report on Patentability with Written Opinion issued Aug. 20, 2009, for International Patent Application No. PCT/US07/61703, 7 pages.

Office Action issued Dec. 3, 2009, for U.S. Appl. No. 11/852,295, 10 pages.

Baker Hughes, Non-Inflatable Mechanical Isolation Packers, undated, 2 pages.

Halliburton, Swellpacker Isolation System, H07827, Sep. 2010, 3 pages.

Journal of Non-Crystalline Solids, Highly Swellable Sol-Gels Prepared by Chemical Modification of Silanol Groups Prior to Drying, vol. 351 No. 40-42 pp. 3174-3178 dated Aug. 17, 2005, 5 pages.

Produced Water Absorbers, Swelling Glass, "Osorb" and a 21st Century Materials Company, undated, 28 pages.

Swellfix UK LTD., Swellfix DynaFORM Packer Brochure, vol. 1, dated Jan. 14, 2009, 2 pages.

Halliburton, SwellTchnology Systems, "Swellpaker System Solves Casing Challenge to Successfully Seal and Anchor North Sea Well Tieback Liner", H06750, dated May 2009, 2 pages.

TAM, Casing Annulus Packers and Accessories, dated Mar. 2005, 20 pages.

Written Opinion issued Apr. 2007 for International Patent Application No. PCT/US06/060926, 3 pages.
Russian Office Action issued Jan. 11, 2010, for Russian Patent Application Serial No. 2009113625, 2 pages.
English Translation of Russian Office Action issued Jan. 11, 2010, for Russian Patent Application Serial No. 2009113625, 2 pages.
Office Action issued Apr. 15, 2010, for U.S. Appl. No. 11/852,295, 7 pages.
Office Action issued Jun. 16, 2010, for U.S. Appl. No. 12/016,600, 47 pages.
Office Action issued Oct. 19, 2011, for U.S. Appl. No. 12/972,438, 15 pages.
International Search Report with Written Opinion issued Feb. 10, 2012 for PCT Patent Application No. PCT/US11/047802, 12 pages.
Office Action issued Jun. 30, 2011 for U.S. Appl. No. 12/016,600, 13 pages.
Office Action issued Mar. 16, 2011 for U.S. Appl. No. 12/016,600, 8 pages.
Office Action issued Jun. 8, 2011 for U.S. Appl. No. 12/972,438, 19 pages.
Advisory Action issued Jan. 10, 2012 for U.S. Appl. No. 12/972,438, 5 pages.
Office Action issued Apr. 18, 2012 for U.S. Appl. No. 12/972,438, 11 pages.
Office Action issued Sep. 25, 2012 for U.S. Appl. No. 12/870,470, 43 pages.
Office Action issued Sep. 28, 2012 for U.S. Appl. No. 12/972,438, 12 pages.
Office Action issued Feb. 12, 2013 for U.S. Appl. No. 12/870,476, 16 pages.

* cited by examiner

WELL TOOLS UTILIZING SWELLABLE MATERIALS ACTIVATED ON DEMAND

CROSS-REFERENCE TO RELATED APPLICATION

This application is a division of prior application Ser. No. 12/410,042 filed on Mar. 24, 2009 now U.S. Pat. No. 8,047,298. The entire disclosure of this prior application is incorporated herein by this reference.

BACKGROUND

This disclosure relates generally to equipment utilized and operations performed in conjunction with a subterranean well and, in an example described below, more particularly provides well tools utilizing swellable materials which are activated on demand.

Swellable materials have been used in the past to perform various functions in well tools. For example, a swellable material may be used in a packer seal element to provide a packer assembly which is self-actuating downhole. When an appropriate fluid contacts the swellable material, the material swells and seals off an annulus in the well.

However, if the fluid is already present in the well, the swellable material can begin to swell as soon as it is installed in the well, which can lead to various problems. For example, the material could swell prematurely, which could prevent the packer assembly from being appropriately positioned in the well.

Techniques have been proposed for delaying the swelling of a swellable material but, in general, these techniques produce somewhat inaccurate delay times and can only be conveniently initiated at one time (e.g., when the swellable material is installed in the well). It has also been proposed to initiate swelling in response to application of pressure to an annulus surrounding the well tool, but if the well tool is used in an open hole, or in perforated or leaking casing, it may not be possible or convenient to apply pressure to the annulus.

Therefore, it will be appreciated that it would be desirable to provide improvements in the art of activating swellable materials in subterranean wells. Such improvements could be useful for initiating actuation of packer assemblies, as well as other types of well tools.

SUMMARY

In the disclosure below, well tools and methods are provided which solve at least one problem in the art. One example is described below in which swelling of a swellable material is initiated on demand, e.g., at a chosen time after the material is conveyed into a well. Another example is described below in which swelling of the swellable material is initiated on demand by applying pressure to a tubing string, or by transmitting a signal via telemetry.

In one aspect, a well tool described below includes a generally tubular mandrel including a flow passage extending longitudinally through the mandrel. A flow controller initially prevents a fluid from contacting a swellable material, but the flow controller permits the fluid to contact the swellable material in response to manipulation of pressure in the flow passage.

In another aspect, a well tool is provided which includes a swellable material, a generally tubular mandrel and a conduit wrapped circumferentially about the mandrel. The conduit contains a fluid which, upon contact with the swellable material, causes the swellable material to swell.

In yet another aspect, a method of actuating a well tool in a subterranean well includes the step of manipulating pressure in a flow passage extending through a tubular string, thereby opening at least one flow control device of the well tool which selectively permits fluid communication between a reservoir of the well tool and a swellable material of the well tool. In this manner, fluid in the reservoir is made to contact the swellable material.

In a further aspect, a well tool provided by this disclosure includes a swellable material and a flow controller which initially prevents a fluid from contacting the swellable material, but which permits the fluid to contact the swellable material in response to receipt of a signal transmitted via telemetry from a remote location. The telemetry signal may be selected from a group including acoustic, pressure pulse, tubular string manipulation and electromagnetic signals.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
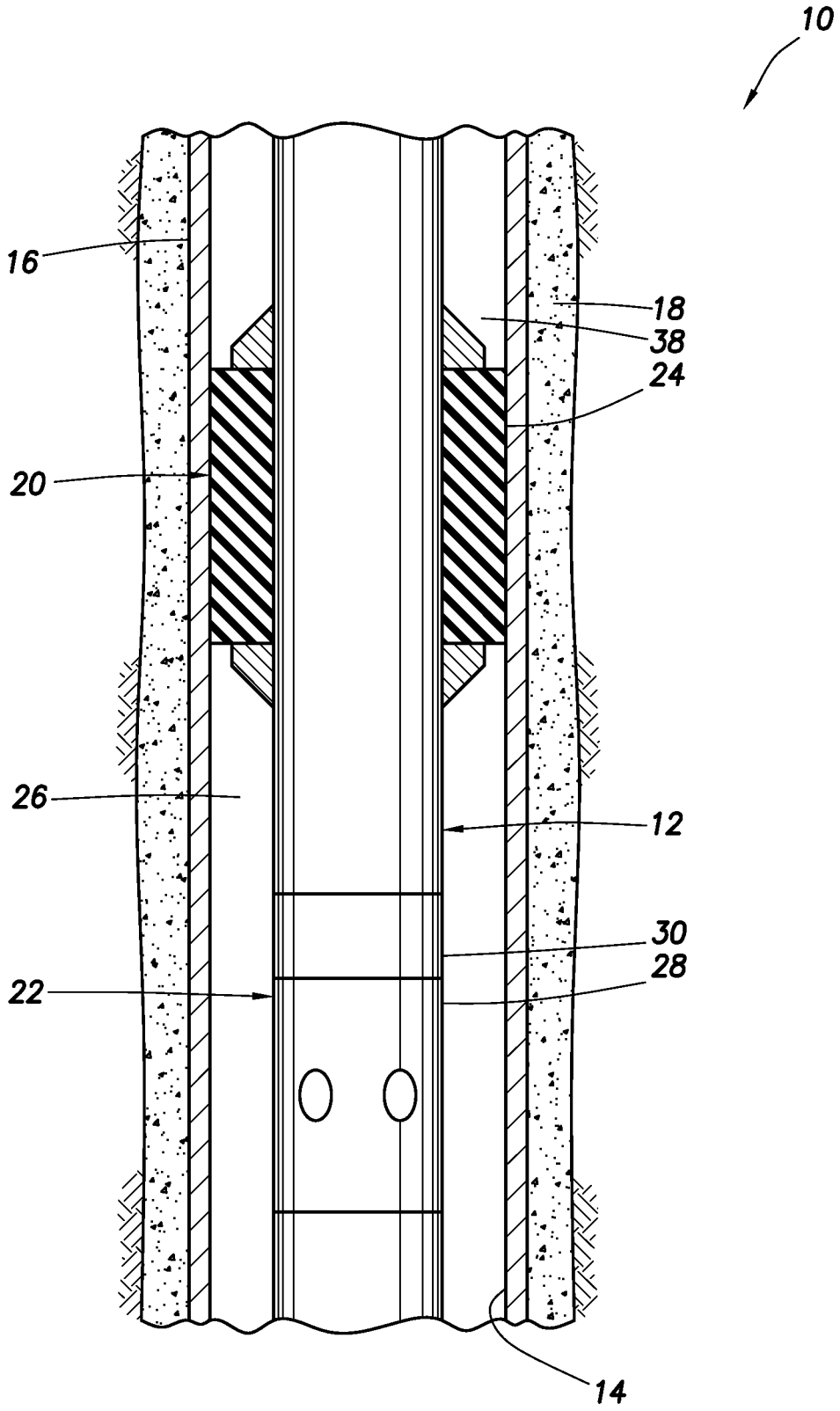
FIG. 1 is a partially cross-sectional schematic view of a well system embodying principles of the present disclosure.

Representatively illustrated in FIG. 1 is a well system 10 and associated method which embody principles of the present disclosure. In the well system 10, a tubular string 12 is installed in a wellbore 14. In this example, the wellbore 14 is lined with casing 16 and cement 18, but the wellbore could instead be unlined or open hole in other embodiments.

The tubular string 12 includes well tools 20 and 22. The well tool 20 is depicted as being a packer assembly, and the well tool 22 is depicted as being a valve or choke assembly. However, it should be clearly understood that these well tools 20, 22 are merely representative of a variety of well tools which may incorporate principles of this disclosure.

The well tool 20 includes a swellable material 24 for use as an annular seal to selectively prevent flow through an annulus 26 formed between the tubular string 12 and the casing 16. Swellable materials may be used as seals in other types of well tools in keeping with the principles of this disclosure.

For example, another type of swellable seal is described in U.S. Published Application No. 2007-0246213 for regulating flow through a well screen. The entire disclosure of this prior application is incorporated herein by this reference.

The well tool 22 includes a flow control device 28 (such as a valve or choke, etc.) and an actuator 30 for operating the flow control device. Swellable materials may be used in other types of actuators for operating other types of well tools.

For example, actuators using swellable materials for operating well tools are described in U.S. Published Application No. 2007-0246225. The entire disclosure of this prior application is incorporated herein by this reference.

The swellable material used in the well tools 20, 22 swells when contacted by an appropriate fluid. The term "swell" and similar terms (such as "swellable") are used herein to indicate an increase in volume of a swellable material.

Typically, this increase in volume is due to incorporation of molecular components of the fluid into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The fluid which causes swelling of the swellable material could be water and/or hydrocarbon fluid (such as oil or gas). The fluid could be a gel or a semi-solid material, such as a hydrocarbon-containing wax or paraffin which melts when exposed to increased temperature in a wellbore. In this manner, swelling of the material could be delayed until the material is positioned downhole where a predetermined elevated temperature exists. The fluid could cause swelling of the swellable material due to passage of time.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367, 7,059,415 and 7,143,832, the entire disclosures of which are incorporated herein by this reference.

The swellable material may have a considerable portion of cavities which are compressed or collapsed at the surface condition. Then, when being placed in the well at a higher pressure, the material is expanded by the cavities filling with fluid.

This type of apparatus and method might be used where it is desired to expand the material in the presence of gas rather than oil or water. A suitable swellable material is described in International Application No. PCT/NO2005/000170 (published as WO 2005/116394), the entire disclosure of which is incorporated herein by this reference.

It should, thus, be clearly understood that any swellable material which swells when contacted by any type of fluid may be used in keeping with the principles of this disclosure.

Figure 2:
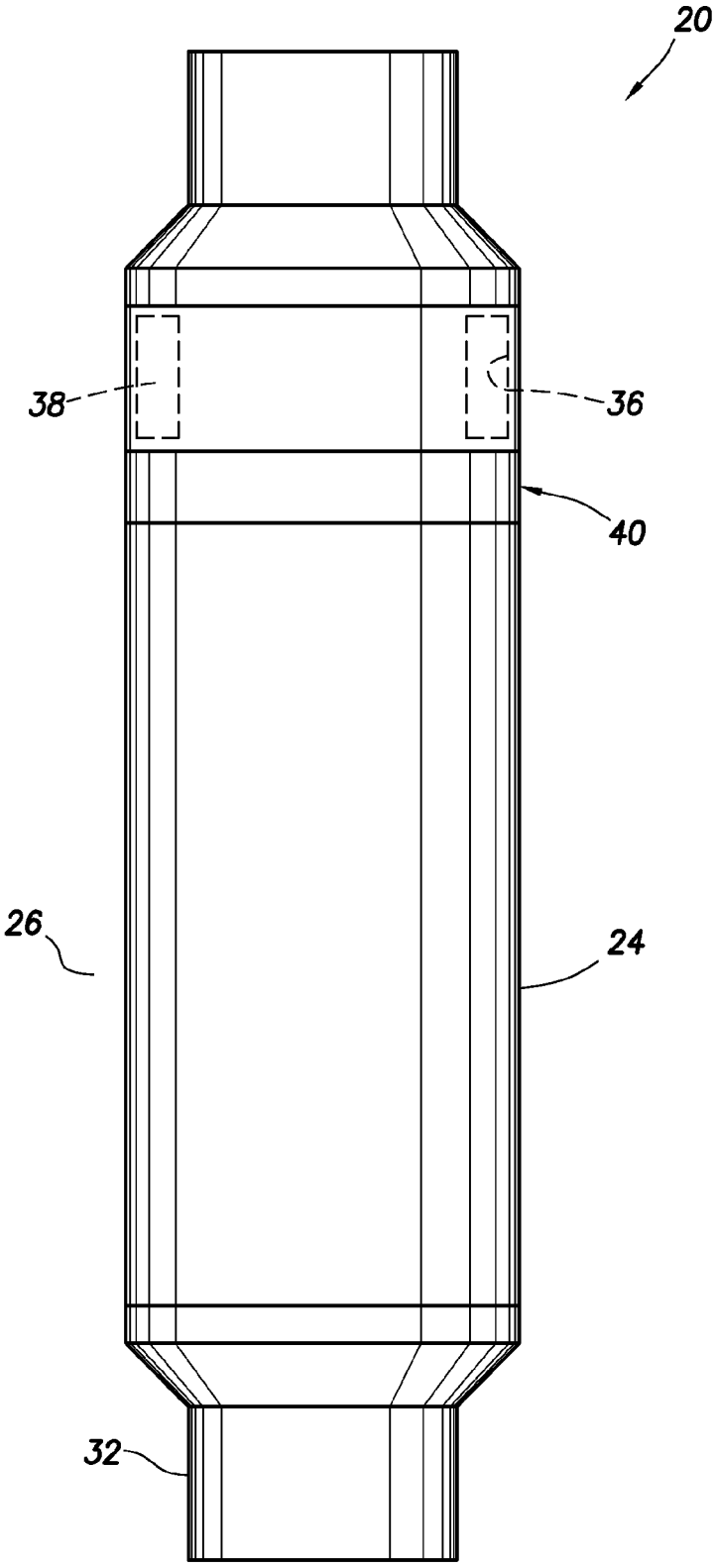
FIG. 2 is an enlarged scale schematic elevational view of a well tool which may be used in the well system of FIG. 1.

Referring additionally now to FIG. 2, an enlarged scale representative elevational view of one possible configuration of the well tool 20 is representatively illustrated. The well tool 20 is used for convenience to demonstrate how the principles of this disclosure may be beneficially incorporated into a particular well tool, but any other type of well tool may utilize the principles of this disclosure to enable swelling of a swellable material of the well tool.

As depicted in FIG. 2, the swellable material 24 is positioned on a generally tubular mandrel 32. The swellable material 24 could, for example, be adhesively bonded to the mandrel 32, or the swellable material could be otherwise secured and sealed to the mandrel.

A flow passage 34 (not visible in FIG. 2, see FIGS. 3-13) extends longitudinally through the mandrel 32. When the well tool 20 is interconnected as part of the tubular string 12, as in the system 10 of FIG. 1, the flow passage 34 also extends longitudinally through the tubular string, and so pressure in the flow passage can be conveniently manipulated from the surface or another remote location.

The well tool 20 also includes a reservoir 36 containing a fluid 38 which, when it contacts the swellable material 24, will cause the material to swell. The reservoir 36 may take various forms, and several examples are described in more detail below.

A flow controller 40 is used to control fluid communication between the reservoir 36 and the swellable material 24. In this manner, the fluid 38 only contacts the swellable material 24 when desired. Preferably, the flow controller 40 initially prevents the fluid 38 from contacting the swellable material 24, but permits such contact in response to a predetermined manipulation of pressure in the passage 34 (e.g., application of at least a minimum pressure in the passage).

Figure 3:
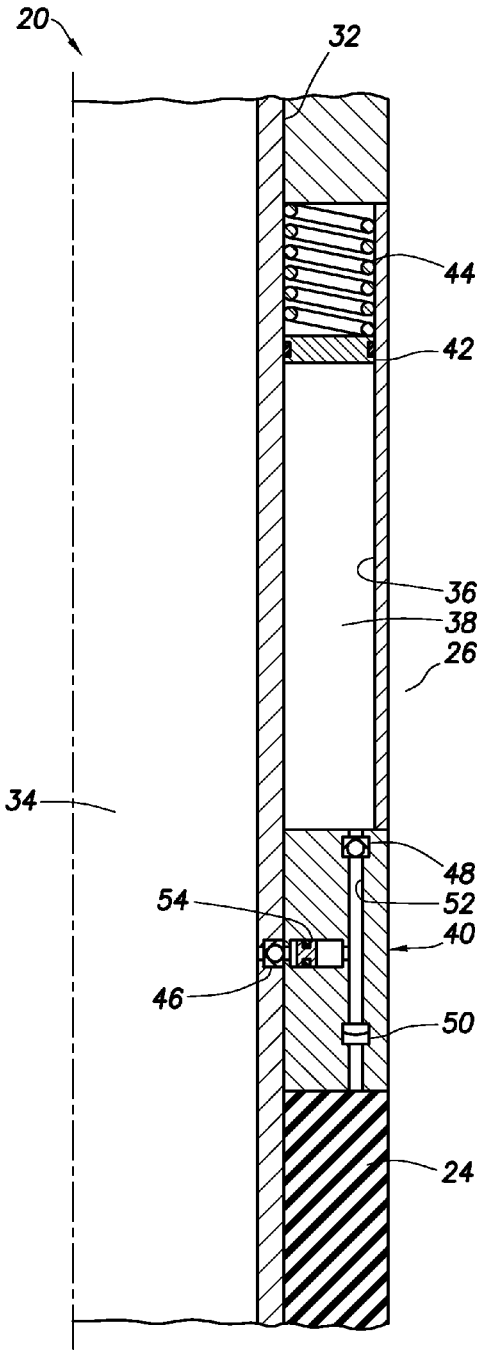
FIGS. 3-13 are enlarged scale schematic cross-sectional views of examples of fluid reservoirs and flow controllers which may be utilized in the well tool of FIG. 2.

Referring additionally now to FIG. 3, an enlarged scale schematic cross-sectional view of a portion of the well tool 20 is representatively illustrated. In this view, details of the reservoir 36 and flow controller 40 can be clearly seen.

The fluid 38 in the reservoir 36 is pressurized somewhat due to a biasing force applied to a piston 42 by a biasing device 44 (such as a spring, pressurized gas chamber, etc.). Note that, in this example, the reservoir 36 is isolated from pressure in the annulus 26, and from pressure in the passage 34. However, in other examples, pressure in the annulus 26 or passage 34 could be used to pressurize the fluid 38 in the reservoir 36.

The flow controller 40 includes flow control devices 46, 48, 50. The device 46 is depicted as a check valve which permits flow from the passage 34 to an interior passage 52 of the controller 40, but prevents oppositely directed flow. The device 48 is depicted as a check valve which permits flow from the reservoir 36 to the passage 52, but prevents oppositely directed flow. Other types of one-way valves or other devices may be used, if desired.

The device 50 is depicted as a rupture disc which isolates the swellable material 24 from the passage 52 until pressure in the passage reaches a predetermined amount (i.e., until a predetermined pressure differential is applied across the device), at which point the device opens and permits fluid communication between the passage 52 and the swellable material. The device 50 could instead comprise any type of valve or other flow control device which initially prevents fluid communication, but which can then permit fluid communication in response to receipt of a predetermined signal. Additional examples of the device 50 are described more fully below.

When installed in the well, the passage 52 may contain the fluid 38 in the area between the devices 46, 48, 50. An equalizing device 54 (such as a floating piston, membrane, diaphragm, etc.) may be used to isolate fluid in the passage 52 from fluid in the passage 34 in order to prevent contamination of the fluid in the passage 52, while permitting transmission of pressure from the passage 34 to the passage 52.

When it is desired to initiate swelling of the swellable material 24, pressure in the passage 34 is increased to at least the predetermined amount (i.e., to apply the predetermined pressure differential across the device 50), at which point the device 50 opens. The fluid 38 is then permitted to contact the swellable material 24, and the material swells in response to such contact.

Note that the swellable material 24 may be provided with passages therein for allowing the fluid 38 to contact a greater surface area of the material, to provide for even distribution of the fluid in the material, etc. In addition, the swellable material 24 may be provided with reinforcement and/or other additional features not specifically described herein, but which are known to those skilled in the art.

Figure 4:
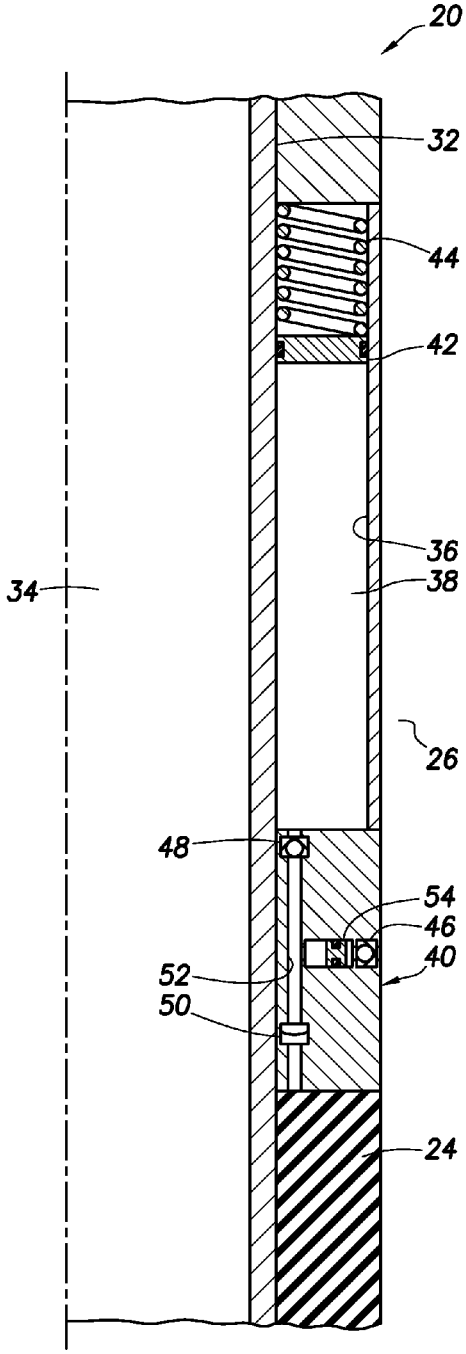

Referring additionally now to FIG. 4, another configuration of the well tool 20 is representatively illustrated. This configuration is similar in most respects to the configuration of FIG. 3, except that the flow controller 40 is responsive to pressure in the annulus 26 to initiate contact between the fluid 38 and the swellable material 24.

When it is desired to initiate swelling of the swellable material 24, pressure in the annulus 26 is increased to at least the predetermined amount (i.e., to apply the predetermined pressure differential across the device 50), at which point the device 50 opens. The fluid 38 is then permitted to contact the swellable material 24, and the material swells in response to such contact.

Figure 5:
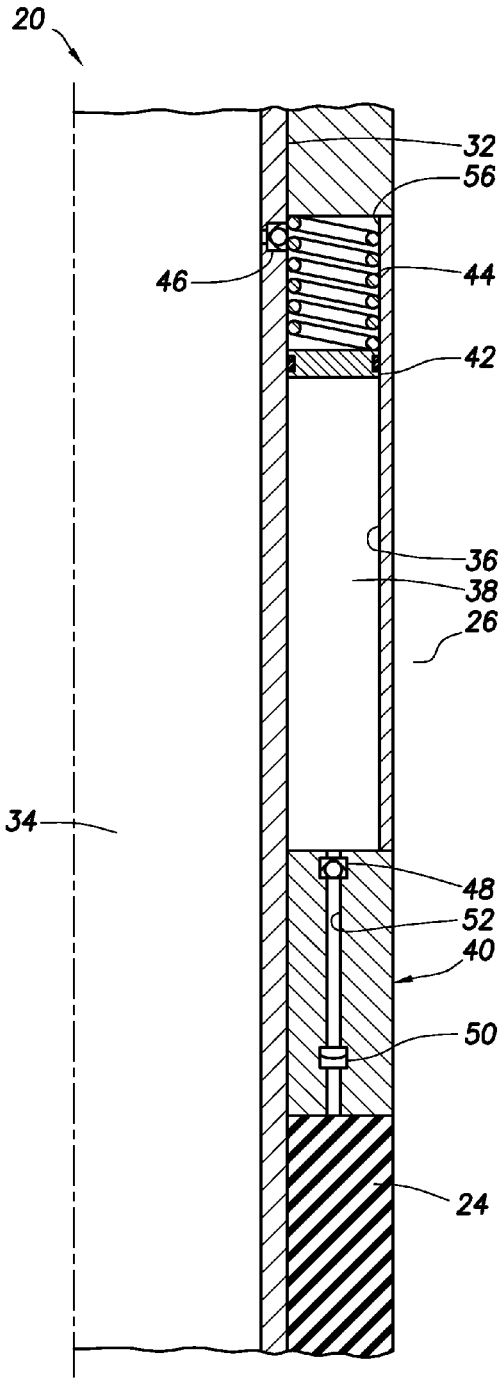

Referring additionally now to FIG. 5, another configuration of the well tool 20 is representatively illustrated. This configuration is similar in most respects to the configuration of FIG. 3, except that the device 46 does not provide for one-way flow from the passage 34 to the passage 52.

Instead, the device 46 provides for one-way flow from the passage 34 to a chamber 56 on an opposite side of the piston 42 from the reservoir 36. In this manner, pressure in the passage 34 is applied to the fluid 38 in the reservoir 36 and, via the device 48, to the passage 52.

When it is desired to initiate swelling of the swellable material 24, pressure in the passage 34 is increased to at least the predetermined amount (i.e., to apply the predetermined pressure differential across the device 50), at which point the device 50 opens. The fluid 38 is then permitted to contact the swellable material 24, and the material swells in response to such contact.

Figure 6:
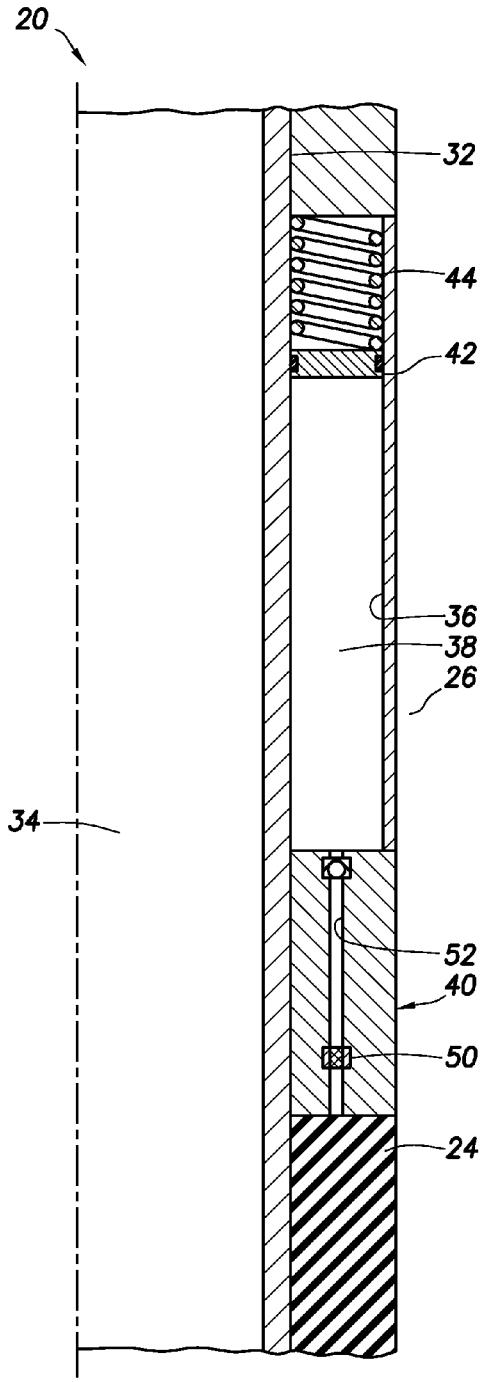

Referring additionally now to FIG. 6, another configuration of the well tool 20 is representatively illustrated. In this configuration, the devices 46, 48 are not necessarily utilized, and the device 50 is in the form of a plug or valve including a material which is responsive to elevated temperature.

When a predetermined elevated temperature is reached downhole, the material melts or liquefies, thereby opening the device 50 and allowing fluid communication between the reservoir 36 and the swellable material 24 to thereby initiate swelling of the swellable material. The material which melts or liquefies in the device 50 could comprise, for example, a eutectic material.

Figure 7:
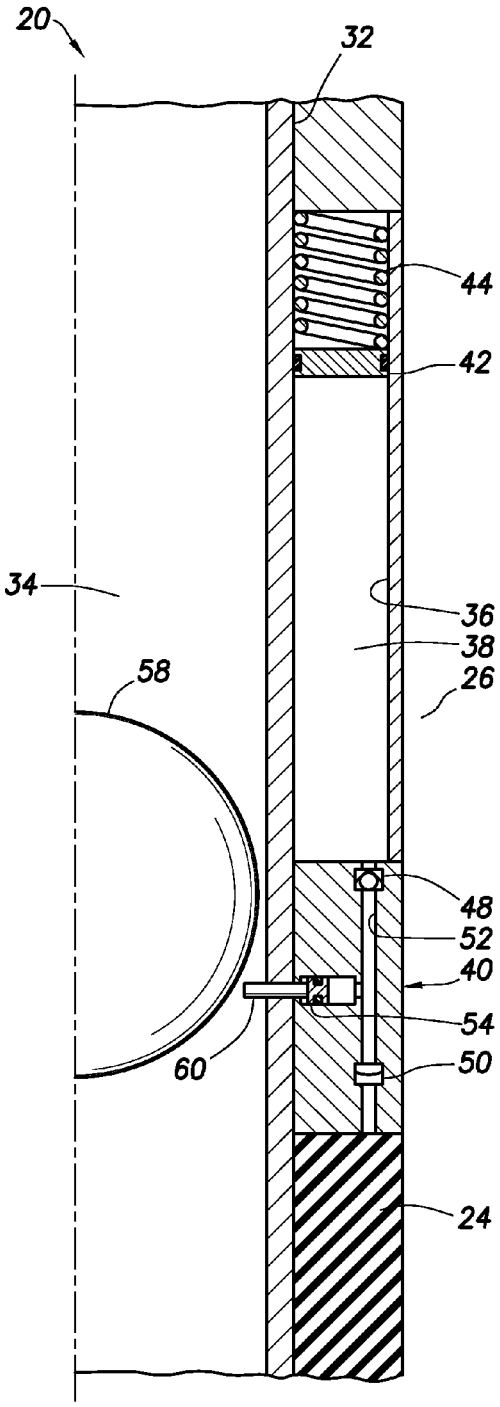

Referring additionally now to FIG. 7, another configuration of the well tool 20 is representatively illustrated. In this configuration, pressure is applied to the passage 52 by displacing the device 54 from within the passage 34.

When it is desired to initiate swelling of the swellable material 24, a ball or other plugging device 58 is dropped or conveyed into the passage 34 and pressure is applied to the passage above the ball, so that the ball biases a plunger 60 radially outward. The outward displacement of the plunger 60 also displaces the device 54 outward, thereby increasing pressure in the passage 52 to open the device 50 and allow the fluid 38 to contact the swellable material 24.

A seat or other sealing surface may be provided for the ball 58 in the passage 34. The ball 58 may not directly contact the plunger 60, instead the pressure applied above the ball may operate to shift a sleeve which, in turn, causes outward displacement of the plunger (or a dog, lug, etc.) which causes outward displacement of the device 54 to increase pressure in the passage 52.

Figure 8:
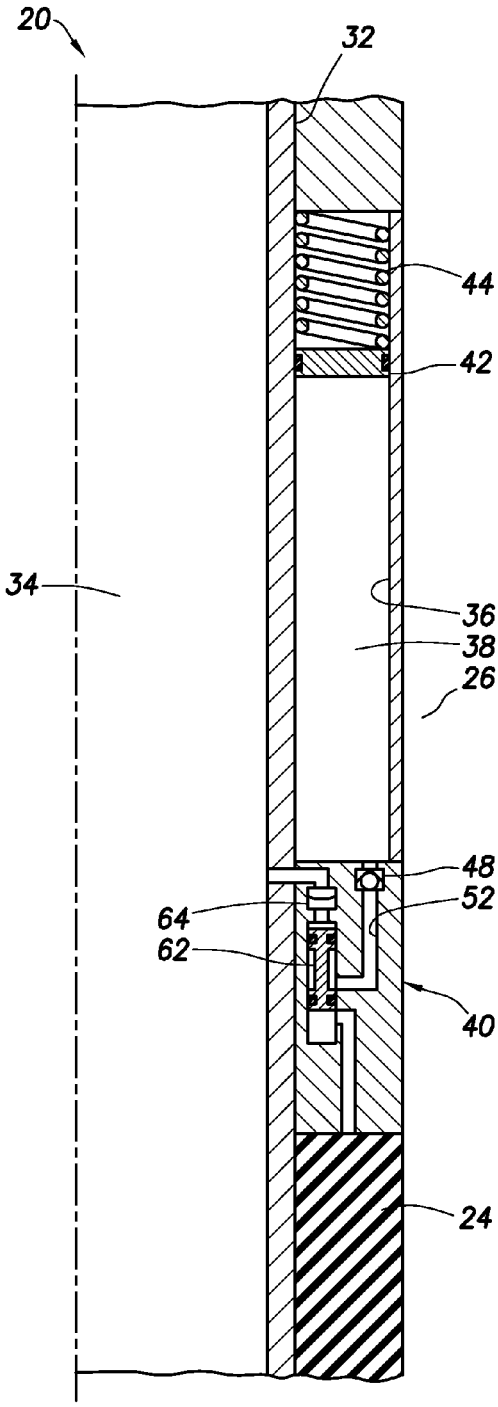

Referring additionally now to FIG. 8, another configuration of the well tool 20 is representatively illustrated. In this configuration, the device 50 is not in the form of a rupture disc, but is instead in the form of a shuttle valve 62 which is operated by opening a rupture disc 64.

When it is desired to initiate swelling of the swellable material 24, pressure in the passage 34 is increased until a predetermined pressure differential is applied across the rupture disc 64, at which point the rupture disc opens. A resulting pressure differential across the shuttle valve 62 causes it to open, thereby permitting fluid communication between the reservoir 36 and the swellable material 24 via the passage 52.

Figure 9:
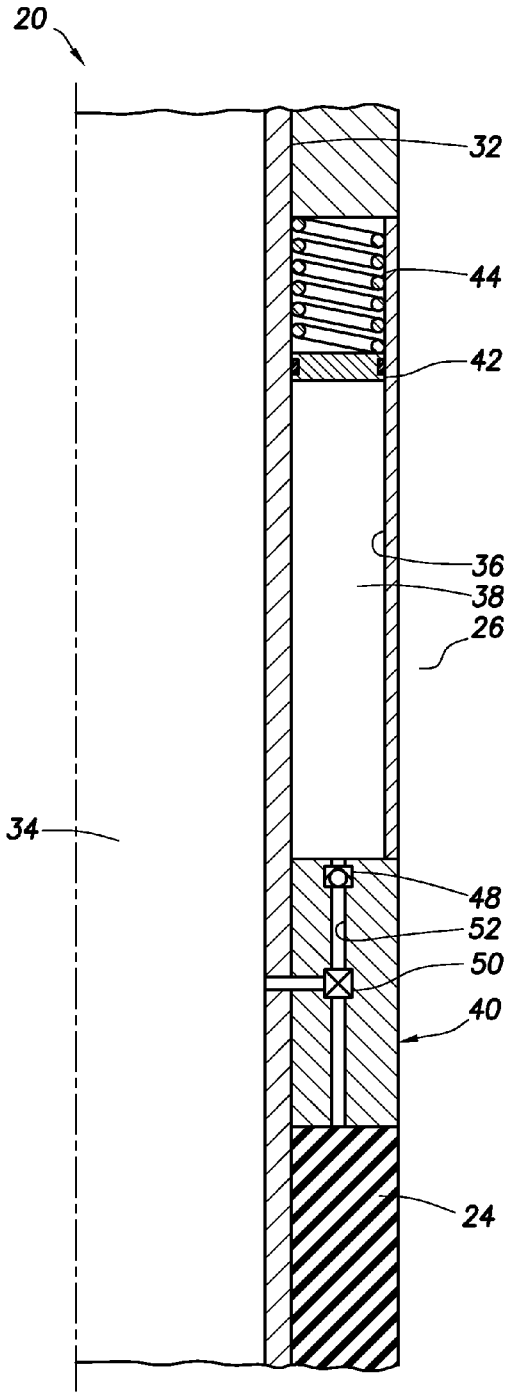

Referring additionally now to FIG. 9, another configuration of the well tool 20 is representatively illustrated. In this configuration, the device 46 is not necessarily used, and the device 50 is in the form of a valve which opens in response to manipulation of pressure in the passage 34.

The device 50 could, for example, be a pilot-operated valve which opens in response to a predetermined pressure being applied to the passage 34. The device 50 could be a valve which opens in response to a predetermined pattern of pressure pulses, levels, etc., applied to the passage 34.

When it is desired to initiate swelling of the swellable material 24, pressure in the passage 34 is manipulated as needed to cause the device 50 to open and permit fluid communication between the reservoir 36 and the swellable material 24. The fluid 38 can then flow through the passage 52 to the swellable material 24 to cause it to swell.

Figure 10:
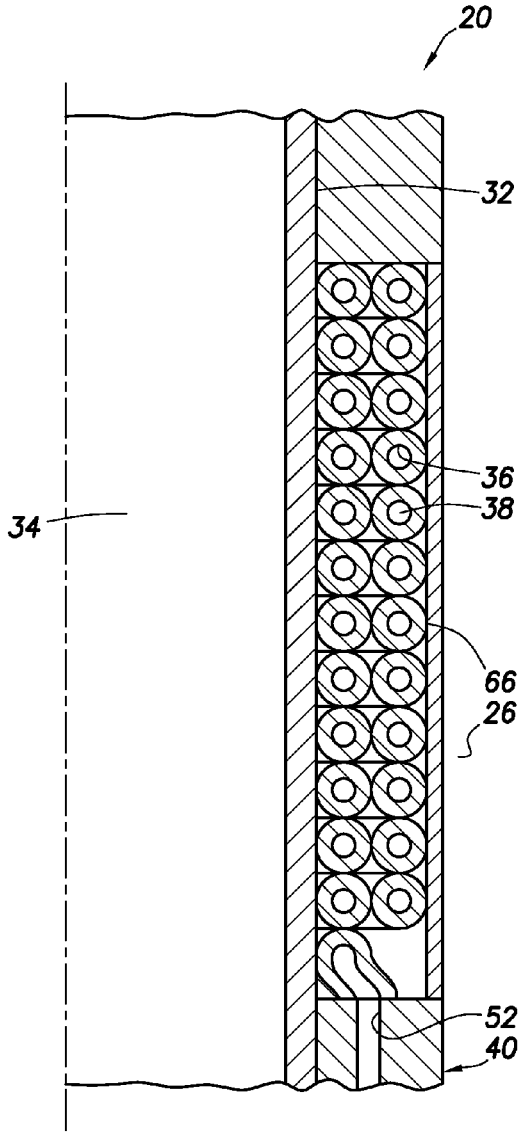

Referring additionally now to FIG. 10, another configuration of the well tool 20 is representatively illustrated. Any of the flow controller 40 configurations described above may be used with this configuration of the well tool 20, and so the details of the flow controller are not depicted in FIG. 10. Instead, the configuration of FIG. 10 utilizes another example of the reservoir 36.

As depicted in FIG. 10, the reservoir 36 is formed in the interior of a conduit 66 wrapped circumferentially and helically about the mandrel 32. The interior of the conduit 66 is in fluid communication with the passage 52 in the flow controller 40.

As temperature in the downhole environment increases (e.g., as the well tool 20 is conveyed into the well), the fluid 38 wants to expand (according to its coefficient of thermal expansion), but it is constrained by the conduit 66, and so pressure in the fluid increases. Thus, in the configuration of FIG. 10, there is no need for the piston 42 and biasing device 44 to pressurize the fluid 38.

Figure 11:
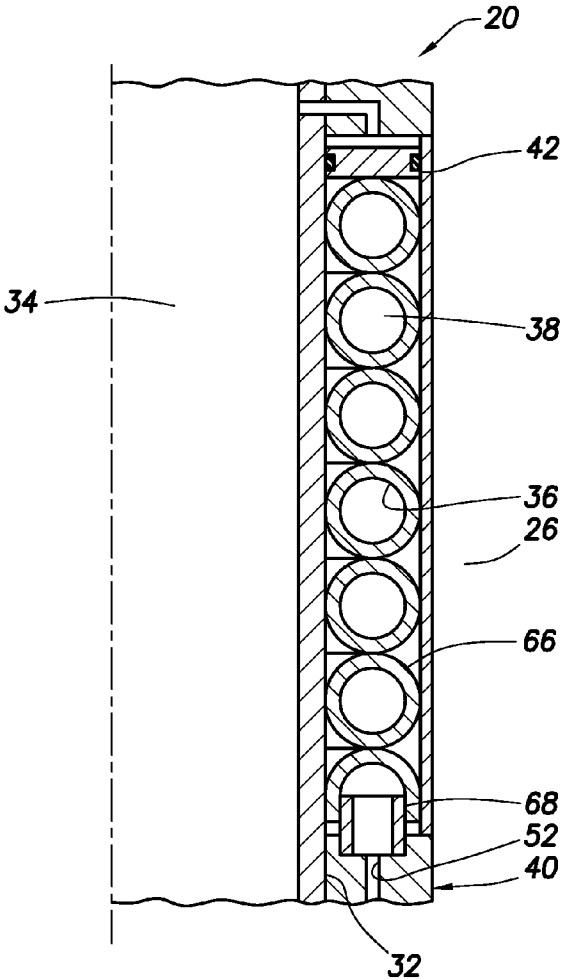

Referring additionally now to FIG. 11, another configuration of the well tool 20 is representatively illustrated. In this configuration, the conduit 66 is larger (as compared to the configuration of FIG. 10) and is only wrapped in one layer about the mandrel 32.

In addition, the conduit 66 is flexible, so that pressure can be readily transmitted across its wall. The piston 42 is used to transmit pressure from the passage 34 to the conduit 66. Thus, the fluid 38 in the conduit 66 is pressurized using pressure in the passage 34. A more rigid and/or rugged conduit 68 (such as a metal braided line, etc.) may be used to connect the conduit 66 to the passage 52.

Figure 12:
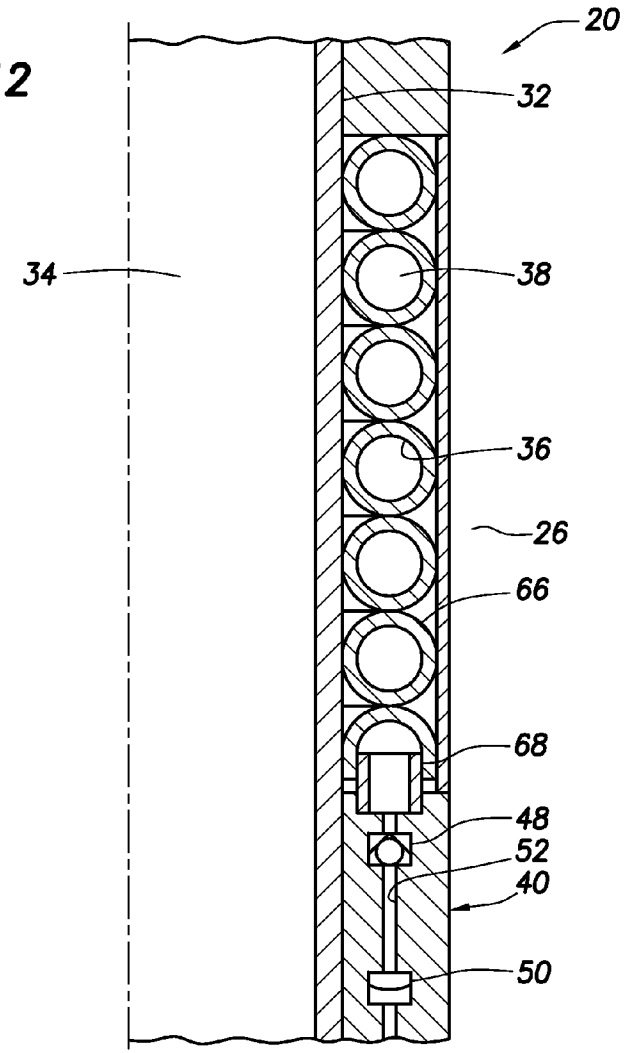

Referring additionally now to FIG. 12, another configuration of the well tool 20 is representatively illustrated. In this configuration, the devices 48, 50 are used in the flow controller 40, in conjunction with the conduit 66 forming the reservoir 36 for the fluid 38.

When pressure in the reservoir 36 increases to a predetermined level (e.g., thereby applying a predetermined pressure differential across the device 50), the device 50 will open and permit flow of the fluid 38 from the reservoir 36 to the swellable material 24 via the passage 52. Pressure in the reservoir 36 may be increased by any means, such as by the fluid 38 being subjected to elevated temperature (as in the configuration of FIG. 10), or by application of pressure from the passage 34 (as in the configuration of FIG. 11).

Figure 13:
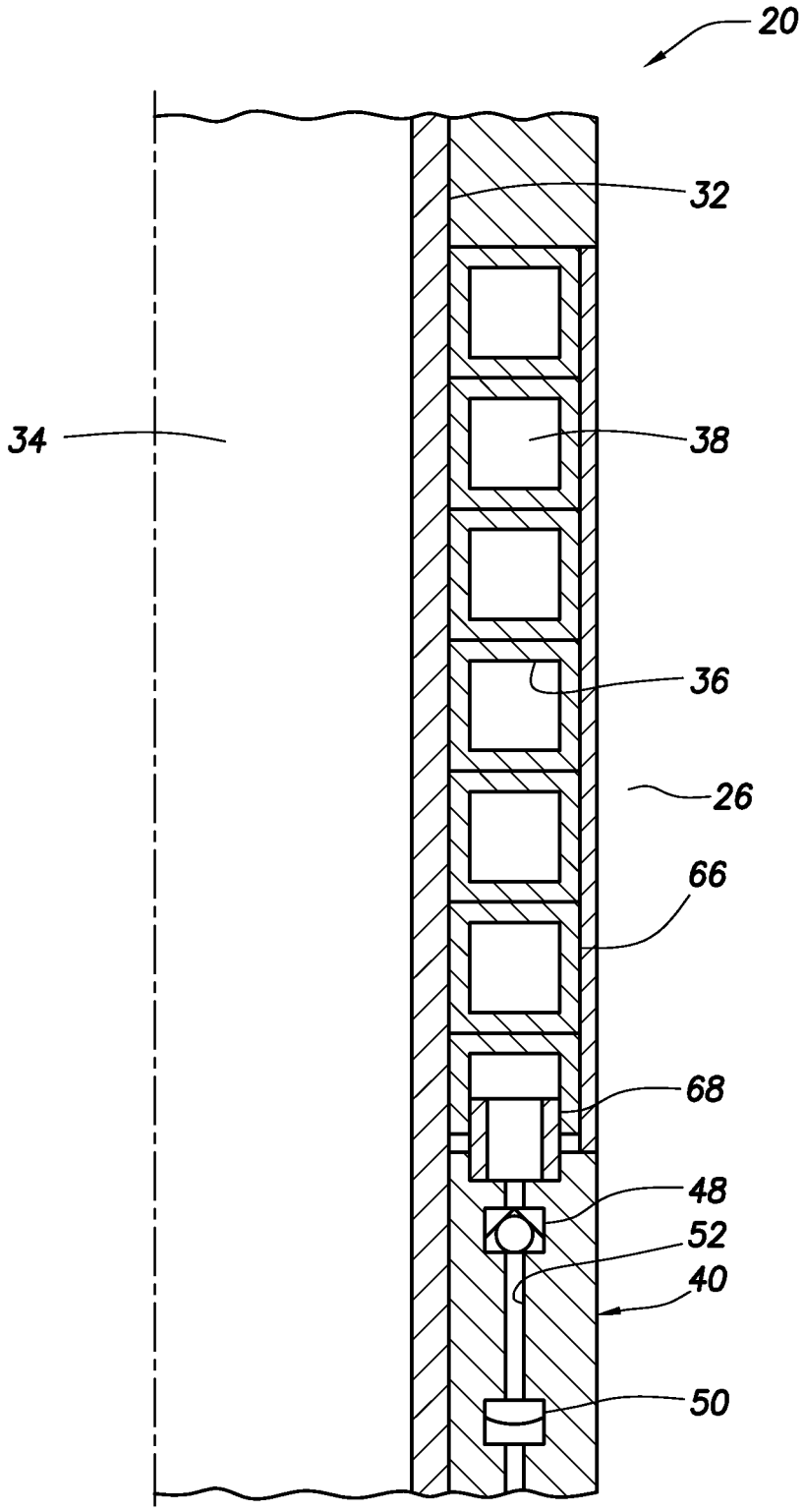

Referring additionally now to FIG. 13, yet another configuration of the well tool 20 is representatively illustrated. This configuration is very similar to the configuration of FIG. 12, except that the conduit 66 is rectangular-shaped, instead of cylindrical as in the configuration of FIG. 12. Otherwise, operation of the well tool 20 as depicted in FIG. 13 is substantially the same as operation of the well tool 20 as depicted in FIG. 12.

Although several specific examples of the well tool 20 are described above, in order to demonstrate a variety of ways in which the principles of this disclosure may be incorporated into a well tool, note that there exists an even wider variety of well tool configurations which can possibly utilize the disclosure principles. Furthermore, any of the features described above for one of the embodiments can be used with any of the other embodiments, so any combination of the features described above can be used in keeping with the principles of this disclosure.

For example, the embodiments of the well tool 20 described above utilize application of pressure to initiate contact between the fluid 38 and the swellable material 24 via the flow controller 40 (and its associated flow control devices 46, 48, 50, valve 62 and/or rupture disc 64). However, the flow controller 40 could instead, or in addition, incorporate flow control devices which are responsive to signals transmitted via acoustic, pressure pulse, tubular string manipulation or electromagnetic telemetry from a remote location. Suitable telemetry responsive flow controllers are described as an actuator, valves and control device in copending U.S. application Ser. No. 12/353,664, filed on Jan. 14, 2009, the entire disclosure of which is incorporated herein by this reference.

The above disclosure describes a well tool 20 which comprises a generally tubular mandrel 32 including a flow passage 34 extending longitudinally through the mandrel 32. A flow controller 40 initially prevents a fluid 38 from contacting a swellable material 24, but permits the fluid 38 to contact the swellable material 24 in response to manipulation of pressure in the flow passage 34.

The swellable material 24 may extend circumferentially about an exterior of the mandrel 32. In this manner, the well tool 20 could be a packer assembly. However, other types of well tools (such as the well tool 22) may incorporate the principles of this disclosure, as well.

The fluid 38 may be disposed in a reservoir 36 of the well tool 20. The reservoir 36 may be isolated from pressure in the flow passage 34. The reservoir 36 may be isolated from pressure exterior to the well tool 20 (such as in the annulus 26).

A biasing device 44 may apply pressure to the fluid 38 in the reservoir 36. Pressure in the flow passage 34 may be transmitted to at least one flow control device 50 of the flow controller 40, with the flow control device 50 selectively preventing and permitting fluid communication between the reservoir 36 and the swellable material 24.

The flow control device 50 may comprise at least one of a rupture disc and a valve. The well tool 20 may include a pressure equalizing device 54 which isolates the fluid 38 from the flow passage 34.

The flow controller 40 may permit contact between the fluid 38 and the swellable material 24 in response to application of a predetermined elevated pressure in the flow passage 34.

Also described by the above disclosure is a well tool 20 which comprises a swellable material 24, a generally tubular mandrel 32 and a conduit 66 wrapped circumferentially about the mandrel 32. The conduit 66 contains a fluid 38 which, upon contact with the swellable material 24, causes the swellable material to swell.

The conduit 66 may be isolated from pressure in a flow passage 34 extending longitudinally through the mandrel 32.

A flow controller 40 may selectively permit contact between the fluid 38 and the swellable material 24 in response to increased pressure within the conduit 66. Pressure within the conduit 66 may increase in response to thermal expansion of the fluid 38 therein. Pressure within the conduit 66 may increase in response to manipulation of pressure in a flow passage 34 extending longitudinally through the mandrel 32.

The above disclosure also describes a method of actuating a well tool 20 in a subterranean well. The method includes manipulating pressure in a flow passage 34 extending through a tubular string 12, thereby opening at least one flow control device 50 of the well tool 20 which selectively permits fluid communication between a reservoir 36 of the well tool 20 and a swellable material 24 of the well tool, whereby a fluid 38 in the reservoir 36 contacts the swellable material 24.

The swellable material 24 may extend circumferentially about a generally tubular mandrel 32 of the well tool 20. The mandrel 32 may be interconnected as a part of the tubular string 12.

The pressure manipulating step may include transmitting pressure in the flow passage 34 to an exterior of a conduit 66 extending circumferentially about a generally tubular mandrel 32 of the well tool 20, with the mandrel being interconnected as a part of the tubular string 12. The reservoir 36 may comprise an interior of the conduit 66. The flow control device 50 may comprise at least one of a rupture disc and a valve.

Also described by the above disclosure is a well tool 20 which includes a swellable material 24 and a flow controller 40 which initially prevents a fluid 38 from contacting the swellable material 24, but which permits the fluid 38 to contact the swellable material 24 in response to receipt of a signal transmitted via telemetry from a remote location. The telemetry signal may be selected from a group comprising acoustic, pressure pulse, tubular string manipulation and electromagnetic signals.

The above disclosure describes the well tool 20 and associated method, in which the well tool may include the swellable material 24, mandrel 32, flow passage 34, reservoir 36, fluid 38, flow controller 40, piston 42, biasing device 44, flow control devices 46, 48, 50, passage 52, equalizing device 54, chamber 56, ball 58, plunger 60, shuttle valve 62, rupture disc 64 and/or conduits 66, 68. However, a person skilled in the art will understand that a well tool and/or method incorporating the principles of this disclosure could be constructed or performed without use of the specific swellable material 24, mandrel 32, flow passage 34, reservoir 36, fluid 38, flow controller 40, piston 42, biasing device 44, flow control devices 46, 48, 50, passage 52, equalizing device 54, chamber 56, ball 58, plunger 60, shuttle valve 62, rupture disc 64 and/or conduits 66, 68 described above.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of this disclosure, which are not limited to any specific details of these embodiments.

In the above description of the representative examples of this disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well tool, comprising:

a generally tubular mandrel including a flow passage extending longitudinally through the mandrel;

a reservoir containing a fluid; and a flow controller which initially prevents the fluid from contacting a swellable material, but which permits the fluid to contact the swellable material in response to manipulation of pressure in at least one of the flow passage and an annulus surrounding the well tool, wherein at least one of a biasing device, pressure from the flow passage, and pressure from the annulus pressurizes the fluid in the reservoir, whereby the fluid is forced out of the reservoir and into contact with the swellable material when the fluid is permitted by the flow controller to contact the swellable material.

2. The well tool of claim 1, wherein the swellable material extends circumferentially about an exterior of the mandrel.

3. The well tool of claim 1, wherein the fluid causes swelling of the swellable material.

4. The well tool of claim 1, wherein the reservoir is isolated from the flow passage pressure.

5. The well tool of claim 1, wherein the reservoir is isolated from the annulus pressure.

6. The well tool of claim 1, wherein the flow passage pressure is transmitted to at least one flow control device of the flow controller, the flow control device selectively preventing and permitting fluid communication between the reservoir and the swellable material.

7. The well tool of claim 6, wherein the flow control device comprises at least one of a rupture disc and a valve.

8. A well tool, comprising:

a generally tubular mandrel including a flow passage Extending longitudinally through the mandrel;

a reservoir containing a fluid;

a flow controller which initially prevents the fluid from contacting a swellable material, but which permits the fluid to contact the swellable material in response to manipulation of pressure in at least one of the flow passage and an annulus surrounding the well tool, wherein at least one of a biasing device, pressure from the flow passage, and pressure from the annulus pressurizes the fluid in the reservoir, whereby the fluid is forced out of the reservoir and into contact with the swellable material when the fluid is permitted by the flow controller to contact the swellable material, and wherein the flow passage pressure is transmitted to at least one flow control device of the flow controller, the flow control device selectively preventing and permitting fluid communication between the reservoir and the swellable material; and a pressure equalizing device which isolates the fluid from the flow passage.

9. The well tool of claim 1, wherein the flow controller permits contact between the fluid and the swellable material in response to application of a predetermined elevated pressure in the flow passage.

10. A method of actuating a well tool in a subterranean well, the method comprising the steps of:

manipulating pressure in at least one of a flow passage extending through a tubular string and an annulus surrounding the tubular string, thereby opening at least one flow control device of the well tool which selectively permits fluid communication between a reservoir of the well tool and a swellable material of the well tool; and pressurizing a fluid in the reservoir using at least one of a biasing device, pressure from the flow passage, and pressure from the annulus, whereby the fluid is forced out of the reservoir and into contact with the swellable material when fluid communication between the reservoir and the swellable material is permitted by the flow control device.

11. The method of claim 10, wherein the swellable material extends circumferentially about a generally tubular mandrel of the well tool, and wherein the mandrel is interconnected as a part of the tubular string, in the pressure manipulating step.

12. The method of claim 10, wherein the flow control device comprises at least one of a rupture disc and a valve in the pressure manipulating step.

13. The method of claim 10, wherein the fluid causes swelling of the swellable material.

14. A well tool, comprising:

a swellable material;

a reservoir containing a fluid; and a flow controller which initially prevents the fluid from contacting the swellable material, but which permits the fluid to contact the swellable material in response to receipt of a signal transmitted via telemetry from a remote location, wherein at least one of a biasing device and pressure exterior to the reservoir pressurizes the fluid in the reservoir, whereby the fluid is forced out of the reservoir and into contact with the swellable material when the fluid is permitted by the flow controller to contact the swellable material.

15. The well tool of claim 14, wherein the swellable material extends circumferentially about an exterior of a generally tubular mandrel.

16. The well tool of claim 14, wherein the fluid causes swelling of the swellable material.

17. The well tool of claim 14, wherein the reservoir is isolated from pressure in a flow passage extending longitudinally through a generally tubular mandrel, the swellable material extending circumferentially about an exterior of the mandrel.

18. The well tool of claim 14, wherein the reservoir is isolated from the annulus pressure.

19. The well tool of claim 14, wherein the signal is selected from a group comprising acoustic, pressure pulse, tubular string manipulation and electromagnetic signals.

* * * * *

UNITED STATES PATENT AND TRADEMARK OFFICE

CERTIFICATE OF CORRECTION

PATENT NO. : 8,453,750 B2
APPLICATION NO. : 13/197973
DATED : June 4, 2013
INVENTOR(S) : Kristian Solhaug et al.

It is certified that error appears in the above-identified patent and that said Letters Patent is hereby corrected as shown below:

In the Claims
Column 10, line 58,
Claim 18, second line thereof, cancel "the."

Signed and Sealed this
Twenty-fourth Day of December, 2013

Margaret A. Focarino

Margaret A. Focarino
*Commissioner for Patents of the United States Patent and Trademark Office*